United States Patent [19]

Daniel

[11] Patent Number: 4,667,274

[45] Date of Patent: May 19, 1987

[54] SELF-ILLUMINATION PATCH ASSEMBLY

[76] Inventor: Maurice Daniel, 289 Wyleswood Dr., Berea, Ohio 44017

[21] Appl. No.: 788,637

[22] Filed: Oct. 17, 1985

[51] Int. Cl.[4] ..... F21L 15/14

[52] U.S. Cl. ..... 362/106; 362/105; 362/300; 362/347; 2/209.2; 2/199

[58] Field of Search ..... 362/103, 105, 106, 300, 362/301, 347; D26/38; 2/199, 196, 209.1, 209.2; 40/329

[56] References Cited

U.S. PATENT DOCUMENTS

| | | | |
|---|---|---|---|
| 1,572,210 | 2/1926 | Kolibas | 362/106 |
| 1,730,571 | 10/1929 | Hamilton | 362/347 |
| 2,203,028 | 6/1940 | Parrillo | 362/106 |
| 4,532,579 | 7/1985 | Merryman | 362/812 |

FOREIGN PATENT DOCUMENTS

| | | | |
|---|---|---|---|
| 227464 | 10/1909 | Fed. Rep. of Germany | 40/329 |
| 446183 | 6/1927 | Fed. Rep. of Germany | 362/106 |
| 385110 | 5/1908 | France | 40/329 |
| 1401264 | 4/1965 | France | 362/106 |
| 21319 | of 1892 | United Kingdom | 40/329 |

*Primary Examiner*—William A. Cuchlinski, Jr.
*Assistant Examiner*—D. M. Cox
*Attorney, Agent, or Firm*—Sixbey, Friedman & Leedom

[57] ABSTRACT

A cap mounted self-illuminating patch which includes a reflector unit mounted to extend partially through the front surface of the cap. The reflector unit includes a screen supporting surface which defines the open side of a light chamber, and a light diffusion screen is mounted on the screen supporting surface to extend across the open side of the light chamber. The screen supporting surface and the screen are configured so that the screen substantially conforms in shape to the front surface of the cap, and a mounting structure is provided to space the screen outwardly from the front surface of the cap. Indicia or figures to be illuminated are provided on the screen, and light from a single point light source within the light chamber is substantially evenly distributed across the screen by a back reflector extending outwardly from the screen supporting surface away from the screen to define the light chamber.

15 Claims, 5 Drawing Figures

FIG. 1.
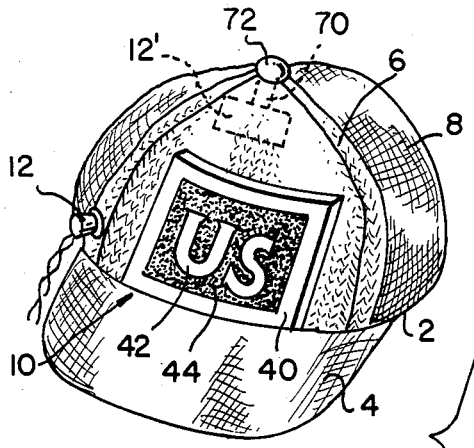
FIG. 2.
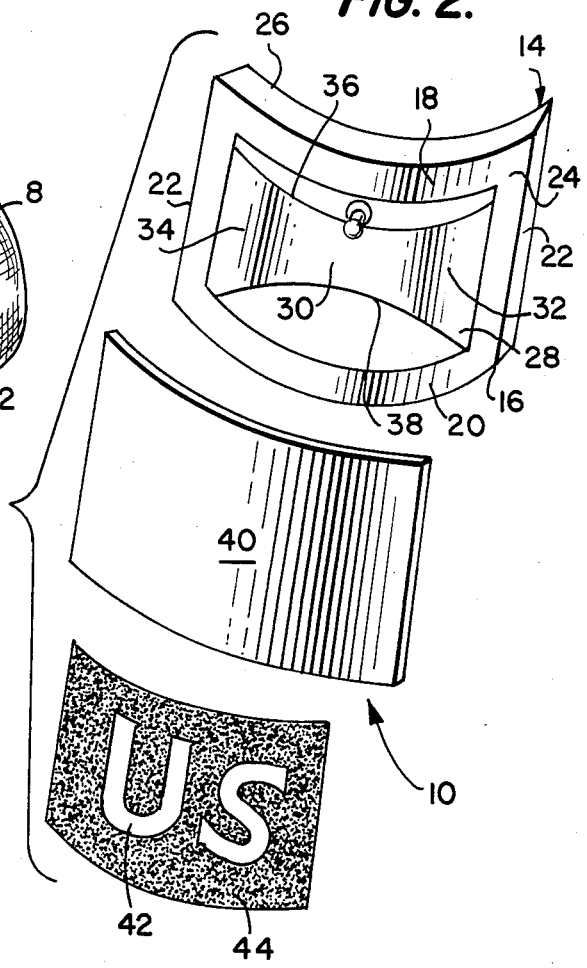
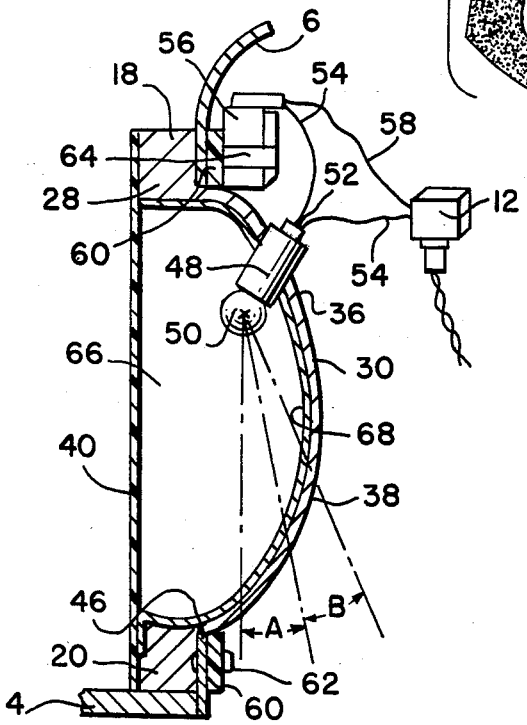
FIG. 3.

SELF-ILLUMINATION PATCH ASSEMBLY

TECHNICAL FIELD

The present invention relates generally to cap mounted light units and more particularly to a self-illuminating patch assembly which can be installed in a conventional cap to uniformly illuminate a figure on the front of the assembly.

BACKGROUND ART

Headgear of various types which are provided with an external light assembly are well known, as illustrated by the well known miners lamps which have been used for centuries. Generally, hat mounted lights have been designed to project a strong beam of light to illuminate a darkened area, such as a work area, and for this purpose, lights are either externally mounted upon a hat as shown by the U.S. patents to Wamsky et al, U.S. Pat. No. 3,032,647 and Cannone, U.S. Pat. No. 4,406,040. Sometimes a plurality of lights are externally mounted upon a hat as shown by the Heminoier U.S. Pat. No. 4,231,079. Generally, hat mounted lighting units which are not entirely external require that a unique hat design be provided as illustrated by the U.S. patents to Rothchild, U.S. Pat. No. 2,501,006 and Weiss U.S. Pat. No. 2,943,186.

Although most prior art hat mounted lighting devices are purely for area illumination, lighting devices have been provided to illuminate indicia or figures mounted upon a hat. Generally, these devices, as illustrated by U.S. Pat. No. 2,203,028 to Parrillo, require a specially designed hat, and are not adapted for mounting on conventional hats or caps. Also, such known devices generally include a single point light source positioned behind the indicia to be illuminated, and uneven illumination and dark spots result. The brightest illumination of the indicia occurs directly opposite the light source, and illumination decreases as the indicia extends laterally from the light source.

DISCLOSURE OF THE INVENTION

It is a primary object of the present invention to provide a novel self-illuminating patch assembly which may be mounted upon a conventional cap and which will evenly illuminate a panel extending across the front of the cap without requiring components which project externally or internally of the cap for a substantial extent.

Another object of the present invention is to provide a novel and improved self-illuminating patch assembly which includes a light diffuser screen and a uniquely formed back reflector which combine to provide a light chamber which scatters light so that it will evenly illuminate the screen. A figure or other indicia to be illuminated is provided over the front face of the screen.

A still further object of the present invention is to provide a novel and improved cap and self-illuminating patch combination wherein the patch is mounted on the front panel of the cap and includes a light diffuser screen and mounting frame therefor which conform to the arcuate configuration of the front panel. The light diffuser screen is spaced outwardly from the front panel of the cap and combines with an oval shaped back reflector which is secured to the mounting frame to form a light chamber for light from a single light source which extends at an angle into the center of the light chamber through the back reflector. The mount for the light source extends angularly through the top of the back reflector in a manner which precludes the shadow of the mount from being projected onto the back reflector.

Yet another object of the present invention is to provide a novel and improved self-illuminating patch assembly which can be mounted on a conventional cap and which includes a light diffuser screen and a back reflector which combine to provide a light chamber for light from a single point light source. The central portion of the back reflector in both the vertical and horizontal directions has a minimum curvature, and maximum curvature of the back reflector toward the screen occurs in both the horizontal and vertical directions in the area adjacent the outermost edges of the back reflector. Thus the back reflector is substantially oval in shape, and it is provided with a flat reflective coating on the inner surface thereof to evenly reflect light from a centrally located light source to the screen.

A still further object of the present invention is to provide a novel and improved self-illuminating patch assembly for a cap which includes a novel back reflector unit for providing light from a single point light source evenly across a screen secured to the back reflector. The screen provides light to indicia at the outer surface thereof, and a mounting unit is provided to removably mount said indicia across said back reflector.

These and other objects are accomplished by providing a self-illuminated patch assembly which fits into an opening formed in the front surface of a cap and which projects on both sides of the cap front surface to provide for the head of a wearer without projecting extensively outwardly from the cap front surface. The patch assembly includes a reflector unit including a screen supporting surface which defines the open side of a light chamber, and a light diffusion screen is mounted on the screen supporting surface to extend across and close the open side of the light chamber. The screen supporting surface and the screen are configured so that the screen substantially conforms to the shape of the front surface of the cap, and a mounting structure is provided to space the screen outwardly from the front surface of the cap. Indicia or figures to be illuminated are provided directly on the surface of the screen or upon a light transmitting structure mounted in front of the screen. This light transmitting structure or a screen directly bearing indicia may be removable so that the indicia can be altered. Light from a single point light source within the light chamber is substantially evenly distributed across the screen by a back reflector extending outwardly from the screen supporting surface and away from the screen to define the light chamber. The surface of the back reflector within the light chamber is formed of a flat, light, reflecting color, and is of a substantially oval configuration. In both the horizontal and vertical directions the curvature of the back reflector is maximum in the area adjacent the peripheral edges thereof and minimum in the central area thereof. A light fixture extends through the top of the back reflector in the area of maximum curvature and angularly into the central portion of the light chamber so that a light bulb mounted in the fixture when illuminated, will not cast the shadow of the fixture upon the back reflector. A battery assembly to power the light bulb is mounted within the cap and is connected to the light fixture through a control switch which may be mounted for operation from outside the cap.

BRIEF DESCRIPTION OF THE DRAWINGS

FIG. 1 is a perspective view of a cap bearing the self-illuminating patch assembly of the present invention;

FIG. 2 is an exploded perspective view of the cap mounted self-illuminating patch assembly of the present invention;

FIG. 3 is a central, vertical cross sectional view of the self-illuminating patch assembly of FIG. 1;

BEST MODE FOR CARRYING OUT THE INVENTION

Figure 4:
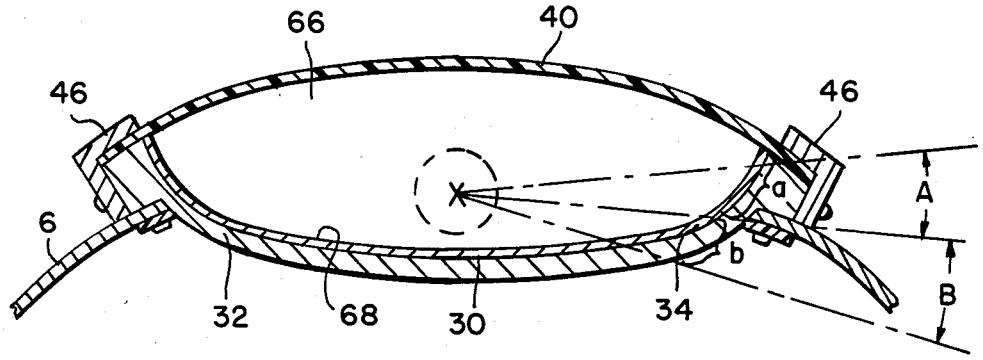
FIG. 4 is a central, horizontal cross sectional view of the self-illuminating patch assembly of FIG. 1 with a decal clamp modification.

Referring to FIG. 1, a conventional baseball type cap 2 having bill 4 is provided with the self-illuminating patch assembly of the present invention. The cap includes a solid front panel 6 of cloth or similar material which is secured to back panels 8 to form an enclosed cap or crown portion. Often the back panels are formed of plastic mesh or a similar net like material to provide ventilation and maintain the arcuate shape of the front panel 6. Hats of other types can be used as long as they include a crown portion with an upper section spaced from the head of a user when the head is received within the crown portion.

The self-illuminating patch assembly of the present invention is mounted upon the front panel of the cap 2 without requiring any alteration of the cap structure other than the provision of a cutout section in the front panel 6 above the bill 4 and a small hole to permit insertion of a control switch 12. The self-illuminating patch assembly includes a reflector unit 14 which may be formed of molded plastic, a suitable metal such as aluminum, or other lightweight material which can be shaped to provide the desired reflector configuration. The reflector unit includes a frame 16 which has an arcuate horizontal cross section curved to substantially conform to the arcuate configuration of the front panel 6. This frame includes outwardly curved top and bottom horizontal bars 18 and 20 which are spaced by vertical side bars 22 connected thereto. When the frame 16 is formed of plastic, the vertical and horizontal bars thereof are appreciably thick to space a front screen support surface 24 of the frame from the rear surface 26 thereof. Normally, the front surface of the frame should be spaced from the front panel 6 of the cap for at least one fourth of an inch when the reflector unit is inserted into the cutout portion in the front panel.

The area defined by the frame 16 is enclosed by a curved back reflector 28 which is secured to the frame and curves rearwardly therefrom beyond the rear surface 26. This back reflector is specifically shaped in accordance with the present invention to minimize the depth of the reflector unit 14 while providing substantially uniform light distribution from a point light source throughout the cavity defined by the back reflector. Although the back reflector 28 is a single piece, it incorporates a compound curvature to provide the desired light scattering capability required. In the horizontal direction in FIG. 2, the central section 30 of the back reflector is relatively flat with maximum curvature beginning at vertical areas 32 and 34 where the back reflector curves into the rear surface of the frame 16. Similarly, in the vertical direction, the central section 30 of the back reflector is again relatively flat while maximum curvature into the rear surface of the frame begins at horizontal areas 36 and 38. Thus in both the horizontal and vertical directions, the curvature of the back reflector is greatest in the outermost sections thereof and minimal in the central section.

The front of the reflector unit 14 is closed by a curved screen 40 which is secured against the front screen support surface 24 of the frame 16. This curved screen is formed of white, translucent material, such as the plastic or translucent fiber material conventionally used in lampshades, and the screen is curved to conform to the arcuate curvature of the frame. The screen may be attached to the surface 24 by adhesive or suitable fastening units.

The outer surface of the screen 40 will support a message, logo or other indicia to be illuminated, and this message, logo or other indicia may be outlined on the screen with opaque paint or inks. However, a better method is to form the message 42 on a separate film or decal 44 and adhere or otherwise support the film or decal on the front face of the screen 40. The film or decal can be opaque or of translucent colored material while the message can be a cutout or transparent material. In some instances the film or decal and the message might be formed of translucent materials in contrasting colors.

It is possible to alter the message or logo on the screen 40 by replacing the film or decal 44 with a curved sheet of thin plastic or other material having the logo 42 formed thereon. Clips or other means, such as the channels 46 in FIG. 4 could then be secured to the sidebars 22 or other portions of the frame 16 to receive and removably support the logo bearing sheet in front of the screen 40. To change the logo or message, a new sheet may then easily be substituted for one previously in place.

FIG. 3 is a vertical cross sectional view of self-illuminating patch assembly 10 taken through the center and widest point of the reflector unit 14. It will be noted that the back reflector 28 protrudes through a rectangular opening 46 cut in the front panel 6 into the cap 2, but this protrusion into the interior of the cap is minimized by the horizontal bars 18 and 20 and the sidebars 22 of the frame 16 which engage the outer surface of the panel 6 and cause the screen 40 to protrude outwardly from the panel. Thus, as shown in FIGS. 3 and 4, a major portion of the reflector unit 14 extends externally of the cap 2, and this external portion may include as much as one third of the total depth of the reflector unit at its deepest point. This leaves ample room for the head of a wearer within the cap, and the reflector unit will normally not come into contact with the wearer's head since it curves outwardly at 38. At central section 30 where the maximum protrusion of the back reflector 28 into the cap occurs, the back reflector is generally spaced about an inch or less inwardly from the panel 6.

The protrusion of the frame 16 and the screen 40 outwardly from the cap 2 is not apparent, since both the frame and the screen are curved to the same curvature as the front panel 6 of the cap. This is best illustrated in FIGS. 1 and 4 wherein it will be noted that what appears to be only a slight outward protrusion from the cap merely serves to accentuate the logo to be illuminated.

To illuminate the screen 40 and the logo 42, a lamp assembly having a socket 48 and an electric bulb 50 is mounted centrally on the back reflector 2. It will be noted that the socket 48 extends at an angle through the back reflector at the upper portion thereof in the area of maximum curvature 36. This angular placement of the socket is important, for it must position the bulb 50 inwardly and spaced from the upper part of the central portion 30 of the back reflector 28 so that the bulb does not cast a shadow of the socket against the back reflector. The outer end of the socket 48 includes a terminal 52 which is connected to conductors 54 leading to a battery unit 56 and to the control switch 12. The control switch is also connected to the battery unit by a conductor 58, so that operation for the switch controls the illumination of the bulb 50. It should be noted that the angular placement of the socket 48 is such that the socket projects into the cap 2 within the confines of the reflector unit 14 and does not extend inwardly beyond the central portion 30 of the back reflector 28 nor does it extend upwardly beyond the back reflector. This permits the battery unit 56 to be mounted on the panel 6 of the cap above the back reflector 28, or, as shown in FIG. 3, the battery can be mounted upon the upper cross bar 18 of the frame 16. In the embodiment of FIG. 3, an annular inner frame member 60 of plastic metal or other suitable material slides over the back reflector 28 when the back reflector is inserted through the rectangular opening 46 in the front panel 6. This inner frame member engages the inner surface of the front panel 6 annularly of the opening 46, and may be attached to the frame 16 by suitable fasteners 62 which extend through the inner frame member and the front panel 6 into the frame 16. The inner frame member is provided with supporting clips 64 for removably retaining the battery unit 56.

From FIGS. 2, 3 and 4, it will be noted that the somewhat oval shaped back reflector 28 operates with the screen 40 to form an enclosed light chamber 66 into which the light socket 48 projects. Since the back reflector is oval with a curvature which is greater near the outermost edge portions thereof as compared with the curvature near the socket 48 and bulb 50, a light chamber which emits light in very nearly equal intensities from all portions of the screen 40 may be formed. The inner surface of the back reflector 28 is coated with a good light reflective coating 68 such as flat white paint. The reflective coating must be flat rather than glossy, for if a shiny surface is used, a specular reflection of light from the bulb 50 will occur which will produce bright spots and dark areas across the surface of the screen 40. In FIGS. 3 and 4, two equal angles A and B have been drawn from the bulb 50 through the back reflector 28. It will be noted that the arc of the back reflector subtended by these angles is approximately equal despite varying distances from the light source. Since equal amounts of light will, in general, be emitted in equal cone angles, the two segments a and b of the back reflector will be about equally illuminated. Thus, because of the approximate oval curvature of the back reflector 28, each portion of the back reflector is receiving and reflecting amounts of light which are approximately the same. The flat reflective coating 68 causes the back reflector to scatter light in all directions and, if the screen 40 is also white, or very light in color, it will form a reflector for some of the light striking its inner surface. Thus the back reflector and screen form a white or very light walled light chamber 66 which emits light in all directions from the screen 40. A high degree of light emitting uniformity is thereby achieved using this simple back reflector and screen configuration there is seen only a barely perceptible brightening on the screen 40 in the area adjacent the bulb 50, and this can be eliminated by using a frosted bulb.

The reflector unit 14 can be manufactured most economically by using a vacuum formed plastic method with an opaque white plastic which then can be coated with the reflective coating 68. The screen 40 can be formed from a white diffuser plastic sheet which is heat sealed or adhesively attached to the reflector unit. The thick frame 16 of the reflector unit is merely one way of spacing the unit outwardly from the front panel 6. Alternatively, this frame could be made thinner, and a foam gasket material could be inserted over the back reflector to space the reflector unit from the cap 2. Also, the control switch 12 could constitute known switching units other than a chain pull switch as illustrated in FIGS. 1 and 3. For example as shown in broken lines in FIG. 1, the chain pull switch could be replaced by a switch 12 having either a rotating or a reciprocating switch operating shaft 70 which extends through the top of the cap 2 to a rounded button 72 which resembles the button at the top of conventional baseball bats. With the switch 12 suitably secured to the crown of the cap 2, the button 72 could be either pressed or rotated to energize or de-energize the bulb 50.

Figure 5:
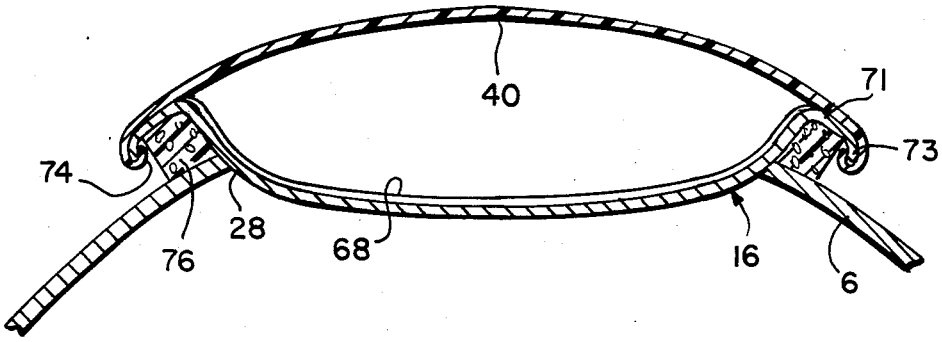
FIG. 5 is a central, horizontal cross sectional view of a second embodiment of the self-illuminating patch assembly.

In FIG. 5, it will be noted that the screen 40 may be formed so that it may be snap fit over the reflector unit 14 and is thereby easily removable therefrom. This is particularly advantageous when the indicia 42 to be illuminated are formed directly on the screen 40 with adhesively backed decals 44 or by permanent means such as paint or ink. A plurality of these screens can then be alternatively attached to the reflector unit to selectively vary the indicia on the cap.

In the embodiment of FIG. 5, the reflector unit 16 is formed with a thin rim 71 which provides the mounting surface for the screen 40. The thin rim or flange 71 has a downturned edge 73 which, with the rim extends around the extent of the back reflector 28. The screen 40 is provided with a peripheral edge which curves downwardly and under the edge 73 as shown at 74. The edge of the screen is configured to snap over the edge 73 of the flange 71, and when the screen and back reflector are plastic which is vacuum formed, the relative flexibility of the two permits the screen to be snapped in place or removed from the flange 71. Now, with the indicia 42 provided directly on the outer surface of the screen 40, a screen may be easily removed and replaced by another screen to change the indicia.

In some embodiments of the self-illuminated patch assembly 10, such as that illustrated in FIG. 5, a foam gasket 76 may be provided between the front panel 6 of the cap and the reflector unit 16 to space the screen 40 from the cap. Also, it is possible to put foam pads within the cap beneath the back reflector 28 to keep the head of a wearer from contacting the back reflector. Any suitable fastening means or adhesive can be used to secure the self-illuminated patch assembly to the cap.

I claim:

1. A self-illuminating, light-diffusing patch assembly adapted to be mounted on the front surface of a cap having a head receiving cavity, said patch assembly comprising a reflector unit having a screen supporting surface engaging the front surface of said cap and a back reflector means extending outwardly from said screen supporting surface to form an enclosed light chamber open at an open side defined by said screen supporting surface, said light chamber extending at least partially within said head receiving cavity of said cap and said back reflector means not contacting a wearer's head during normal use, a light diffusing screen means mounted on said screen supporting surface, said screen supporting surface and said light diffusing screen means formed so that said screen means substantially conforms to the front surface of said cap and is spaced outwardly from the front surface of said cap, said light diffusing screen means extending across said open side to enclose, with said back reflector means said light chamber, and a single point light source mounted within said light chamber in spaced relationship to said back reflector means and light diffusing screen means, said back reflector means being formed to extend in close proximity to said light diffusing screen means to minimize the cross-sectional dimension of said light chamber while reflecting light from said single light source substantially evenly across the extent of said light diffusing screen means, said light diffusing screen means further operating to diffuse the light reflected thereon to provide even illumination across the extent thereof.

2. The self-illuminating patch assembly of claim 1 wherein said reflector unit includes mounting means for removably mounting said light diffusing screen means on said screen supporting surface.

3. The self-illuminating patch assembly of claim 1 wherein said back reflector means includes an oval shaped reflector which curves away from said screen supporting surface, said oval shaped reflector including a unitary reflector surface which has a maximum curvature in the areas adjacent the peripheral edges thereof and minimum curvature in the central portion thereof.

4. The self-illuminating patch assembly of claim 3 wherein said single point light source includes a light fixture extending through said back reflector means angularly downward into said light chamber, said light fixture being centrally located relative to said oval shaped reflector to extend adjacent to the central portion thereof and a light bulb mounted in said light fixture.

5. The self-illuminating patch assembly of claim 4 wherein said single point light source includes battery means and circuit means including a control switch connecting said battery means to said light fixture.

6. The self-illuminating patch assembly of claim 1 wherein a display to be illuminated is provided on the side of said light diffusing screen means opposite to said light chamber.

7. The self-illuminating patch assembly of claim 6 wherein said display is formed on said light diffusing screen means.

8. A hat with a self-illuminating, light-diffusing patch assembly mounted thereon comprising crown means defining an interior chamber for receiving the top of a wearer's head, said crown means including a top section which is adapted to be spaced from the head of a wearer and a front section which is adapted to extend upwardly from the forehead of a wearer to said top section, said front section having an opening therein, a reflector unit mounted in said opening and extending laterally from said front section on either side thereof, said reflector unit having a screen supporting surface engaging said front section and extending outwardly from said front section on the side thereof opposite to said interior chamber, and a back reflector means extending from said screen supporting surface through the opening in said front section to form a cavity extending at least partially within said interior chamber and opening at an open side defined by said screen supporting surface, said back reflector means not contacting a wearer's head during normal use and being formed to reflect light from a light source within said cavity substantially evenly across the extent of said open side, a light transmitting screen means mounted on said screen supporting surface and conforming substantially to the configuration of said front section of said crown, said light transmitting screen means extending across said open side to form, with said back reflector means an enclosed light chamber, and a light source mounted in said light chamber in spaced relationship to said back reflector means and said light transmitting screen means, said back reflector means being formed to extend in close proximity to said light transmitting screen means to minimize the cross-sectional dimension of said light chamber while reflecting light from said light source substantially evenly across the extent of said light transmitting screen means, said light transmitting screen means further operating to diffuse the light reflected thereon to provide even illumination across the extent thereof.

9. The hat of claim 8 wherein said reflector unit includes means for engaging the front section of said crown means for spacing said light transmitting screen means outwardly from said front section.

10. The hat of claim 9 wherein said reflector unit includes mounting means for removably mounting said light transmitting screen means on said screen supporting surface.

11. The hat of claim 9 wherein said back reflector means includes an oval shaped reflector which curves away from said screen supporting surface, said oval shaped reflector including a unitary reflector surface which has a maximum curvature in the areas adjacent the peripheral edges thereof and minimum curvature in the central portion thereof.

12. The hat of claim 11 wherein said light source includes a light fixture extending through said back reflector means angularly downward into said light chamber, said light fixture being centrally located relative to said oval shaped reflector to extend adjacent to the central portion thereof and a light bulb mounted in said light fixture.

13. The hat of claim 12 wherein a display to be illuminated is provided on the side of said light transmitting screen means opposite to said light chamber.

14. The hat of claim 13 wherein said display is formed on said light transmitting screen means.

15. The hat of claim 12 wherein said light source includes battery means and circuit means including a control switch means connecting said battery means to said light fixture mounted in the internal chamber of said crown means, said control switch means having a switch operating means extending through said crown means to permit operation of said control switch means from externally of said crown means.

* * * * *